US006250786B1

(12) United States Patent
Schuster et al.

(10) Patent No.: US 6,250,786 B1
(45) Date of Patent: Jun. 26, 2001

(54) HEADLIGHT ASSEMBLY WITH ANGULARLY DISPLACED REFLECTOR REGIONS

(75) Inventors: Kurt Schuster, Reutlingen; Gerd Bahnmueller, Holzgerlingen; Doris Boebel, Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/358,296

(22) Filed: Jul. 21, 1999

(30) Foreign Application Priority Data

Jul. 24, 1998 (DE) ..... 198 33 475

(51) Int. Cl.[7] ..... F21V 7/00

(52) U.S. Cl. ..... 362/518; 362/223; 362/297; 362/346

(58) Field of Search ..... 362/516, 517, 362/518, 519, 520, 521, 522, 487, 507, 223, 296, 297, 346, 347

(56) References Cited

U.S. PATENT DOCUMENTS 3,588,492 * 6/1971 Pollock ..... 362/309

* cited by examiner

*Primary Examiner*—Sandra O'Shea
*Assistant Examiner*—Ronald E. DelGizzi
(74) *Attorney, Agent, or Firm*—Michael J. Striker

(57) ABSTRACT

A motor vehicle headlight assembly includes a reflector extending along a focal line and having an open end, a light source including an elongated gas discharge tube extending within the reflector along the focal line for the light issued thereby onto the reflector to be reflected by the latter into the open end, and an at least translucent light-guiding plate spanning the open end of the reflector and operative for directing light passing through it onto an illumination area situated at a predetermined distance in front of the motor vehicle on which the headlight assembly is mounted when in use. The reflector has at least in general the configuration of a flattened cross-sectionally parabolic cylinder and consists at least in part of two opposing regions at least one of which is inclined by a predetermined angle about the focal line with respect to the position it would have assumed in a true cross-sectionally parabolic cylinder.

10 Claims, 3 Drawing Sheets

HEADLIGHT ASSEMBLY WITH ANGULARLY DISPLACED REFLECTOR REGIONS

BACKGROUND OF THE INVENTION

1. Field of the Invention

The present invention relates to motor vehicle headlights in general, and more particularly to such incorporating tubular light sources, especially gas discharge tubes.

2. Description of the Related Art

There are already known various constructions of motor vehicle headlights, among them such which incorporate tubular light sources, especially gas discharge tubes. Each of these headlights or headlight assemblies includes a reflector that is positioned along the tubular light source and incompletely embraces the same to leave an open end toward and through which it reflects the light emanating from the light source and impinging on the reflector. A light-guiding disk or plate spans the open end of the reflector and directs the light emanating from the light source and reflected by the reflector to a predetermined area situated in front of the vehicle on which the headlight assembly is mounted when in use.

In this scenario, it is known to configure the reflector as a cross-sectionally parabolic cylinder constituted by two parabolic branches or regions that are displaced parallel to the longitudinal direction of the reflector. Such cross-sectionally parabolic cylindrical reflectors reflect the light rays emanating from the tubular light source onto them in directions parallel to respective optical planes of such reflectors. Cross-sectionally parabolic cylindrical reflectors of this kind have a multitude of optical axes that are situated next to each other and extend in parallelism with one another, lying in or actually defining the optical plane. In addition, each of such reflectors has a multitude of foci that are disposed next to each other on a focal axis of the reflector.

However, such a cross-sectionally parabolic cylindrical reflector does not embrace or envelop the tubular source to any great extent in that it exhibits a relatively small embracing angle in comparison to the overall size of the reflector. As a consequence of this relatively small extent of the embracing angle, the proportion of the light emitted by the light source that impinges upon and is thus captured by the reflector and reflected by the same is also relatively small. For this reason, these conventional headlight or similar illuminating units with cross-sectionally parabolic cylindrical configurations are capable of issuing only light beams with a relatively low light intensity and/or density and are not suited for applications in which high light density is called for (for instance, in use as a brake light).

In an attempt to solve this relatively low illumination capability problem, it has been proposed in the past to provide the headlight assemblies with larger-dimensioned reflectors of the conventional type. When this measure is resorted to, it is namely possible to increase the aforementioned embracing angle and thus to capture and reflect a greater proportion of the light rays emanating from the light source. Yet, experience has shown that this approach may lead to other problems, especially those stemming from the amount of space occupied on the motor vehicle by such headlight assemblies, especially since, driven by aerodynamic and/or aesthetic considerations, less and less space is being made available on motor vehicles for the accommodation of headlight assemblies. The end result is that a conflict exists between the quest for the highest possible illumination light intensity, on the one hand, and for the smallest possible headlight dimensions, on the other hand.

OBJECTS OF THE INVENTION

Accordingly, it is a general object of the present invention to avoid the disadvantages of the prior art.

More particularly, it is an object of the present invention to provide a motor vehicle headlight assembly that does not possess the drawbacks of the known equipment of this type.

Still another object of the present invention is to devise a headlight assembly of the type here under consideration which issues a highly concentrated light beam onto the area ahead of the vehicle that is to be illuminated.

It is yet another object of the present invention to design the above assembly in such a manner as to keep its overall dimensions to a minimum without adversely affecting its illumination capacity.

A concomitant object of the present invention is so to construct the assembly of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a motor vehicle headlight assembly that includes a reflector having at least in general the configuration of a flattened cross-sectionally parabolic cylinder, a light source including an elongated gas discharge tube extending within the reflector along a common focal line, and an at least translucent light-guiding plate spanning the open end of the reflector. According to the invention, the reflector consists at least in part of two opposing regions at least one of which is inclined by a predetermined angle about the focal line with respect to the position it would have assumed in a true cross-sectionally parabolic cylinder. As a result of this configuration, the light that is issued by the light source onto the reflector is reflected by the latter into the open end, where the light-guiding plate directs the light passing through it onto an illumination area situated at a predetermined distance in front of the motor vehicle on which the headlight assembly is mounted when in use.

A particular advantage of the motor vehicle headlight assembly of the present invention as described so far is that its reflector has much smaller dimensions than those used in conventional assemblies of this kind, and yet exhibits the same embracing angle relative to the light source and, consequently, captures and reflects the same amount of light issued by the latter, as conventional reflectors that follow a truly parabolic course and thus have much larger overall dimensions. Or, viewed from a different vantage point, in the headlight assembly constructed in accordance with the present invention so that its reflector has the aforementioned flattened parabolic cross-sectional configuration, the reflector envelops the light source with a much greater angle than that used in a conventional headlight assembly that conforms to a true parabola in cross section.

It is particularly advantageous when, in accordance with the present invention, not just one but each of the above-mentioned regions of the reflector is inclined about the focal line. The angle of such inclination may be different for each of the reflector regions in question, but it may also be the same for both of them. An advantage of this approach is that, by judiciously selecting the angle(s) of the reflector region (s), it is possible to selectively fashion and/or determine the headlight light distribution into the space in the front of the motor vehicle. The angle by which the cross-sectionally parabolic region or regions are inclined (i.e. angularly displaced from the position(s) it (they) would have assumed had they both followed the parabolic course) has a magnitude of at most 45°. As a general rule, the greater this angle of inclination of the parabolic regions or branches, the greater is the embracing angle by which they envelop the light source and, consequently, also the amount of light emanating from the light source that these regions of the reflector constructed in accordance with the present invention capture and reflect. However, commencing at the angle of inclination of the parabolic reflector regions amounting to about 45°, there is not obtained any further increase in the amount of light captured and reflected by the reflector; rather, light rays emitted by the light source are totally reflected by parabolically shaped reflector regions angularly displaced from their true-parabola positions by more than about 45°.

In accordance with a further advantageous aspect of the present invention, it is proposed that the light-guiding plate be constructed in such a manner as to guide or deflect the light passing through it in substantial parallelism to an optical plane of the reflector. This construction is needed in the context of the present invention because, unlike in the truly cross-sectionally parabolic reflectors of the prior art, where the light rays emanating from the light source and reaching any zone of the reflector, are reflected by the latter for further propagation in parallelism with the optical plane of the reflector, the light rays reflected by the reflector configured in accordance with the present invention in the form of a flattened parabolic cylinder are reflected by the respective affected region to reach the open (i.e. exit) end of the reflector at an angle relative to the optical plane corresponding to that by which the affected region is displaced from the true parabola position. For this reason, the light-guiding plate of the headlight assembly of the present invention must be constructed and/or configured, at least when the angle of displacement of the respective parabolic region has a magnitude equal to or in excess of a certain value, in such a manner as to guide (i.e. deflect or otherwise redirect) the light reaching it and passing through it into substantial parallelism with the optical plane. In this manner, it is possible to assure the required optimum illumination density and/or the desired light distribution for the area in front of the vehicle that is to be illuminated even when the angle(s) of displacement of the reflector region(s) in question from their "prior art" positions is (are) relatively huge, resulting in a situation where the light beam leaving the headlight assembly exhibits a particularly high light intensity.

In accordance with another advantageous feature of the present invention, that zone of either one or both of the aforementioned reflector regions which would reflect light emanating from the light source toward a central region of the light-guiding plate if its local shape followed the general course of the flattened cross-sectionally parabolic cylinder has a configuration different from such local shape. In this connection, it is advantageous when the configuration of such a zone is planar, or cross-sectionally substantially circular, being centered on a center line extending in substantial parallelism with the focal line. However, it is also within the purview of the present invention for this zone to include a plurality of formations shaped as substantially spherical segments. The cross-sectionally substantially circular zone, or the substantially spherical segments or formations, can bulge either outwardly (i.e. be concave), or inwardly (i.e. be convex). By configuring this zone of the reflector in this manner, that is by providing it with a configuration that is different from that it would have had if it followed the course of the remainder of the respective cross-sectionally parabolic reflector region, it is achieved that the light rays reflected form such a differently shaped zone are no longer all reflected towards the center of the light-guiding plate where it would meet in the absence of this feature. As a consequence, otherwise occurring high concentration of the reflected light rays at such central region of the light-guiding plate is not encountered any more, and high temperatures that could arise in that region of the light-guiding plate as a result of the passage of such a relatively high amount of light through this region, and could even cause the material of this region to melt in the event that it is a synthetic plastic material, are avoided as well.

According to yet another advantageous facet of the present invention, the reflector follows a course in its longitudinal direction that substantially conforms to that of the light source. With this orientation, the elongated tubular light source is always embraced by the reflector with embracement angle of the very same magnitude regardless of the spatial course the light source may take. As a result, the light intensity of the headlight assembly constructed in accordance with the present invention is the same over the entire course of the tubular light source.

Last but not least, it is proposed in accordance with the present invention that the aforementioned regions of the reflector be displaced parallel to the longitudinal axis of the reflector.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 2:
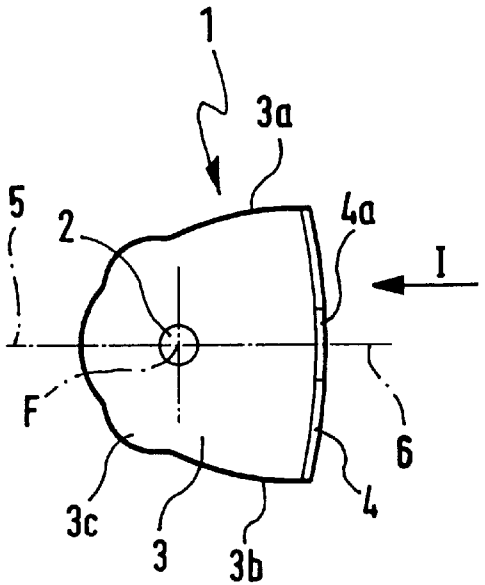
FIG. 2 is a somewhat simplified cross-sectional view taken on line II—II of FIG. 1.
Figure 1:
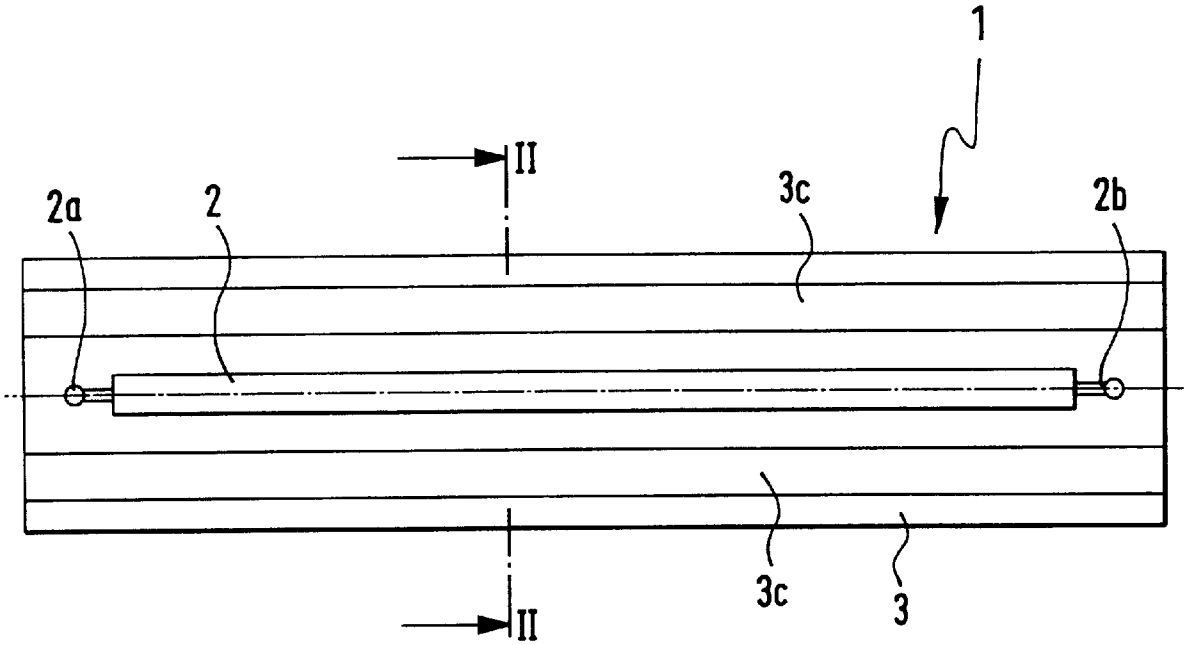
FIG. 1 is a front elevation view of an embodiment of a headlight unit of the present invention.

Referring now to the drawing in detail, and first to FIGS. 1 and 2 thereof, it may be seen that the reference numeral 1 has been used therein to identify an embodiment of a motor vehicle headlight assembly incorporating the present invention, in its entirety. The headlight assembly 1 includes a gas discharge tube 2 as its light source, a reflector 3 that reflects the light rays emitted by the light source 2 toward its open end to eventually collectively form a light beam, and an at least translucent light-guiding disk or plate 4 spanning the open end of the reflector and hence interposed in the propagation path of such a light beam. After passing through the light-guiding plate 4, the light beam is directed onto the roadway in front of the motor vehicle equipped with the headlight assembly 1. The tubular light source 2 is centered on a main axis that extends along, and advantageously coincides with, a straight line 5. This line 5 also constitutes the locus of all foci of the reflector 3; therefore, this straight line 5 also has assigned to it a reference character F, standing for focal line. The gas discharge tube 2, such as a fluorescent tube, includes two electrical contacts 2*a* and 2*b* at its respective ends, by means of which electric energy required for exciting the gaseous medium contained within the tube 2 is supplied to the tube 2.

According to the invention, the reflector 3 has a general configuration of a flattened cross-sectionally parabolic cylinder portion that is constituted by two cross-sectionally parabolic branches or regions 3*a* and 3*b*. As indicated in and as will be discussed in more detail later on in conjunction with FIG. 5 of the drawing, the parabolic regions 3*a* and 3*b* are, or at least one of them is, angularly displaced from what would correspond to a true cross-sectionally parabolic cylinder about the focal line F of the reflector 3; they may be shifted along the longitudinal axis of the reflector 3 as well.

The plate 4 guides the light issued by the light source 2 and reflected by the reflector 3 such as to emerge from it in substantial parallelism with an optical plane 6 of the reflector 3 that extends perpendicularly to the plane of the drawing. All of the optical axes of the reflector 3 are located in the optical plane 6.

FIG. 2 of the drawing shows that a zone 3*c* of the reflector 3 that ordinarily would reflect the light emanating from the tubular light source 2 toward a central region 4*a* of the light-guiding plate 4 is replaced with one having a differently cross-sectionally configured surface the shape of which deviates from that of the abovementioned flattened parabola. In the illustrated embodiment, the zone 3*c* is configured as a cross-sectionally substantially circular convex cylindrical segment that bulges out of the overall shape of the reflector 3. The longitudinal axis of this circularly cylindrical reflector zone 3*c* extends parallel to the longitudinal axis 5 of the reflector 3. However, the replacement zone 3*c* could also extend essentially along a plane and/or have any of a variety of other convex or concave shapes that have not been shown in the drawing, such as one including a multitude of part-spherical formations. Regardless of the ultimately chosen configuration of this replacement zone 3*c*, the purpose of this replacement is always the same: to avoid excessive concentration of the light rays reflected by the reflector 3 in, and thus possible thermal damage to, the central region 4*a* of the light-guiding plate 4.

The course of the reflector 3 in its longitudinal direction follows or substantially conforms to that of the tubular light source 2. In the construction illustrated in FIGS. 1 and 2, the tubular light source extends along a straight course. Correspondingly, then, the reflector 3 also extends along a straight course as considered in its longitudinal direction.

Figure 4:
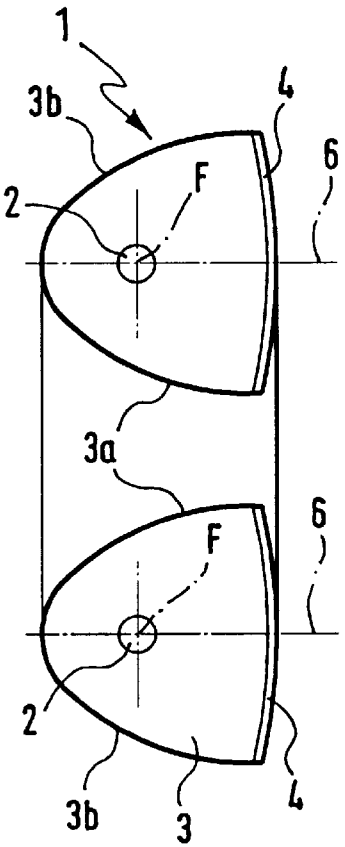
FIG. 4 is a view corresponding to that of FIG. 2 but taken an line IV—IV of FIG. 3.
Figure 3:
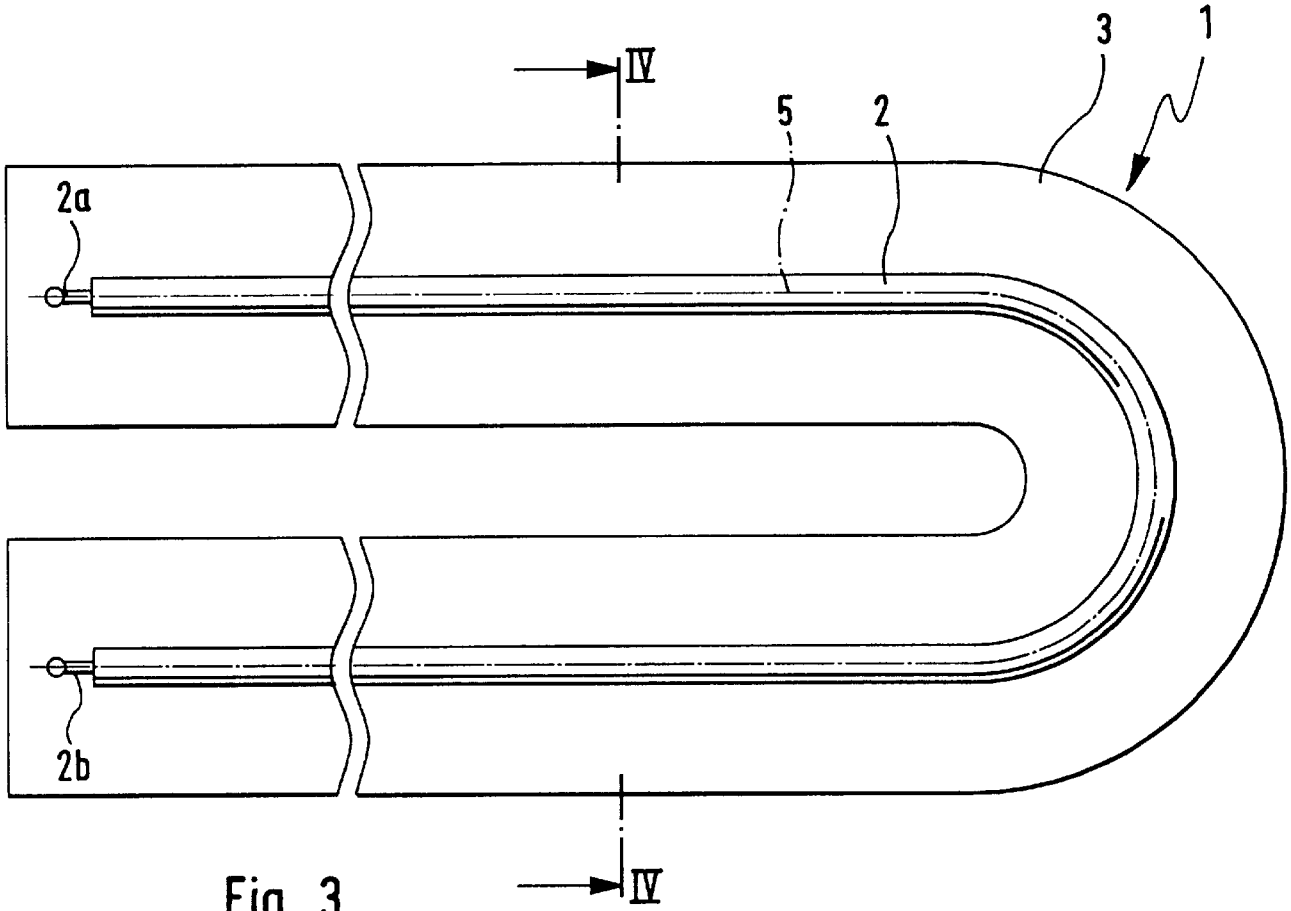
FIG. 3 is a view similar to that of FIG. 1 but showing a modified headlight unit embodiment.

Turning now to FIGS. 3 and 4 of the drawing, it is to be mentioned first that, while there are some differences between the modified embodiment shown there and that described above, they are relatively minor in nature, so that the same reference numerals as before can be and will be used therein to identify corresponding parts. In this case, the gas discharge tube 2 employed in the headlight assembly 1 is U-shaped. Correspondingly, even the reflector 3 exhibits a U-shaped behavior as far as the course it takes in its longitudinal direction is concerned. In contrast to the embodiment described above in conjunction with FIGS. 1 and 2, the segment 3*d* of the reflector 3 that reflects the light emanating from the light source 2 toward the central region 4*a* of the light-guiding plate 4 is not replaced by another one the configuration of which would deviate from a flattened parabolically cylindrical one. Given the shape of the reflector 3, its optical axes 6 are no longer all situated in a single optical plane, but they still extend substantially parallel to each other. Morever, the focal line 5 (or F) on which all of the focal points of the reflector 3 are located is not a straight line any more either, but rather a U-shaped curve.

Figure 5:
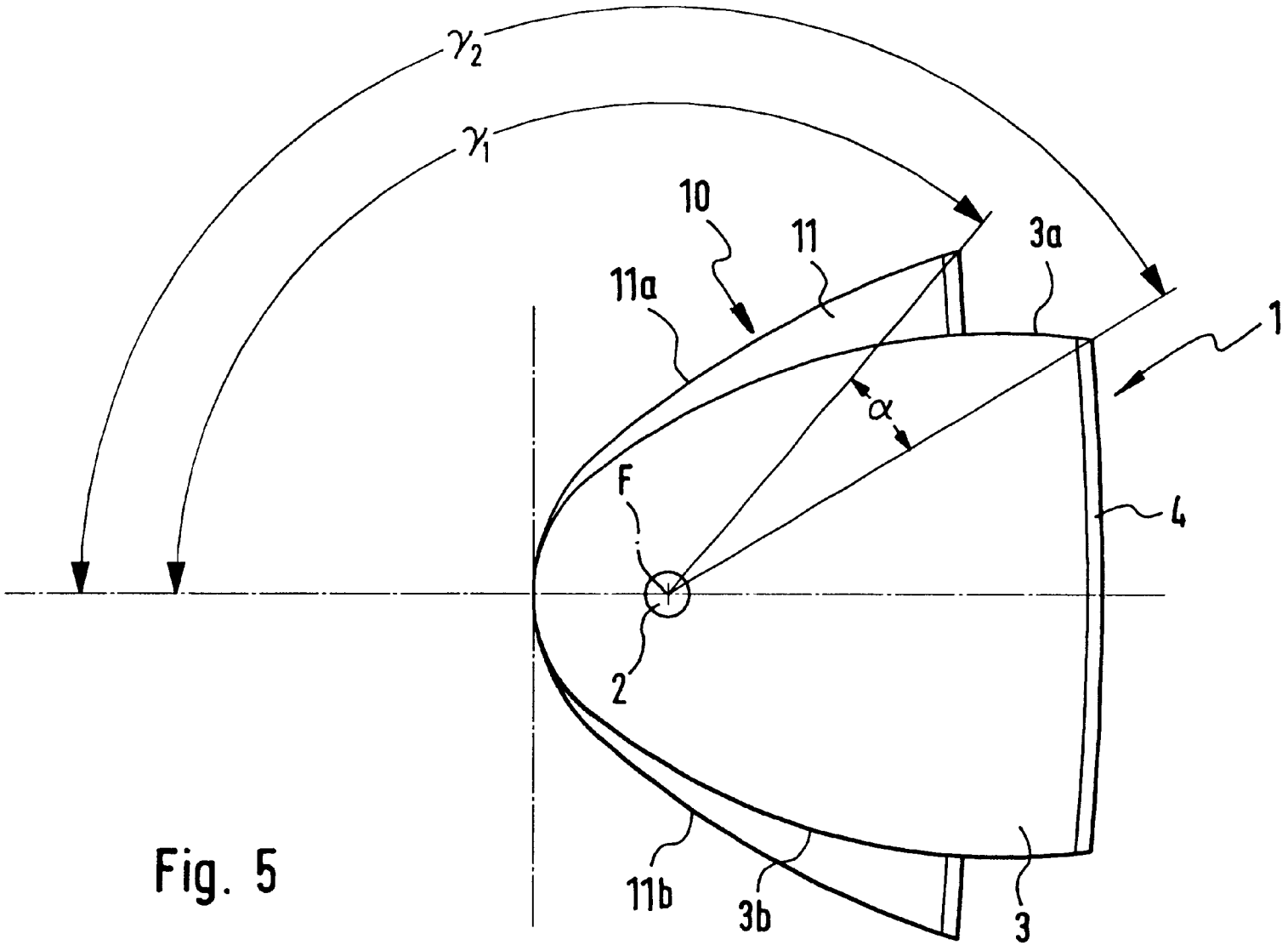
FIG. 5 is a diagrammatic view akin to that of FIG. 2, on a scale enlarged relative to that of the latter, and showing a comparison of a reflector embodying the principles of the present invention with a traditionally configured one.

FIG. 5 of the drawing is not a representation of any actual physical structure; rather, it presents, in a simplified diagrammatic view, a comparison between a conventional headlight assembly 10 including a reflector 11 configured in conformity with the heretofore customary practice of giving it, and especially its reflecting surface, a parabolically cylindrical shape and the headlight assembly 1 of the present invention wherein the reflector 3 has the cross-sectional shape of a flattened parabola, as discussed before. The focal axes or lines F of both of these assemblies 1 and 10 extend along coinciding courses. Like the reflector 3 of the assembly 1, the reflector 11 of the assembly 10 also has two branches or portions 11*a* and 11*b*. However, the reflector portions 3*a* and 3*b* of the reflector 3 of the headlight unit 1 of the present invention are inclined or angularly displaced with respect to the corresponding portions 11*a* and 11*b* of the reflector 11 of the conventionally configured headlight assembly 10. As shown in the upper part of FIG. 5, the reflector portions 3*a* and 11*a* are spaced from one another by an angle a the magnitude of which corresponds to the difference between the angles $Y_1$ and $Y_2$ by which the respective reflector portion 11*a* and 3*a* embraces, surrounds or envelops the focal line F and hence the light source 2. It may be seen that the angle $Y_2$ of the reflector 3 of the headlight unit 1 constructed in accordance with the present invention significantly exceeds in magnitude the angle $Y_1$ encountered on the reflector 11 of the conventionally constructed headlight assembly 10.

On the other hand, the lower part of FIG. 5 indicates that the corresponding reflector portions 3*b* and 11*b* are separated from one another by an angle $\beta$. While this angle $\beta$ is shown to be smaller than the aforementioned angle $\alpha$, it could be, in accordance with the present invention, larger or even equal to it. As a matter of fact, it is also within the realm of the present invention to make one of the angles $\alpha$ and $\beta$ equal to zero, so long as the other is greater than zero. In either event, the magnitude of the angle $\alpha$ or is no greater than 45°.

It will be understood that each of the elements described above, or two or more together, may also find a useful application in other types of constructions differing from the type described above.

While the present invention has been described and illustrated herein as embodied in a specific construction of a headlight assembly for a motor vehicle, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

We claim:

1. A motor vehicle headlight assembly comprising an elongated reflector (3) having a longitudinally extending focal line (F) and a transverse cross-section, said transverse cross-section being at least approximately in the form of a flattened parabola;

an elongated gas discharge tube (2) extending within said reflector along said focal line (F) and acting as a source of light reflected by said elongated reflector (3); and a light guiding plate (4) arranged in front of the reflector (3) and through which the light from the reflector passes;

wherein said transverse cross-section of said elongated reflector (3) comprises two parabolic segments (3*a*,3*b*) arranged on opposite sides of said focal line (F) respectively, said parabolic segments being angularly displaced relative to each other and from corresponding positions in a purely parabolic cross-section, so that said transverse cross-section is at least approximately in the form of said flattened parabola.

2. The headlight assembly as defined in claim 1, wherein both of said parabolic segments (3*a*,3*b*) are displaced by angular displacements of equal magnitude from said corresponding positions in said purely parabolic cross-section to form said transverse cross-section at least approximately in the form of said flattened parabola.

3. The headlight assembly as defined in claim 1, wherein both of said parabolic segments (3*a*,3*b*) are displaced by angular displacements of unequal magnitude from said corresponding positions in said purely parabolic cross-section to form said transverse cross-section at least approximately in the form of said flattened parabola.

4. The headlight assembly as defined in claim 1, wherein each of said parabolic segments (3*a*,3*b*) is displaced by respective predetermined angles ($\alpha$,$\beta$) about said focal line of at most 45° from said corresponding positions in said purely parabolic cross-section.

5. The headlight assembly as defined in claim 1, wherein said transverse cross-section of said elongated reflector (3) has a non-parabolic segment (3*c*) shaped differently from said parabolic segments (3*a*,3*b*) and said non-parabolic segment (3*c*) is arranged to reflect the light from the gas discharge tube to a central region of said light-guiding plate (4).

6. The headlight assembly as defined in claim 5, wherein said non-parabolic segment (3*c*) is a straight line.

7. The headlight assembly as defined in claim 5, wherein said non-parabolic segment (3*c*) is a circular segment.

8. The headlight assembly as defined in claim 5, wherein said non-parabolic segment (3*c*) comprises a plurality of facets and each of said facets is a circular segment.

9. A brake light for a motor vehicle comprising an elongated reflector (3) having a longitudinally extending focal line (F) and a transverse cross-section, said transverse cross-section being at least approximately in the form of a flattened parabola;

an elongated gas discharge tube (2) extending within said reflector along said focal line and acting as a source of light reflected by said elongated reflector (3); and a light guiding plate (4) arranged in front of the reflector (3) and through which the light from the reflector passes;

wherein said transverse cross-section of said elongated reflector (3) comprises two parabolic segments (3*a*,3*b*) arranged on opposite sides of said focal line respectively, said parabolic segments being angularly displaced relative to each other from corresponding positions in a purely parabolic cross-section, so that said transverse cross-section is at least approximately in the form of said flattened parabola.

10. A reflector for a motor vehicle headlight assembly, said reflector comprising a flattened parabolic cylinder that is open on one side and having a longitudinally extending focal line;

wherein said elongated reflector (3) has a transverse cross-section comprising two parabolic segments (3*a*, 3*b*) arranged on opposite sides of said focal line respectively, said parabolic segments being angularly displaced relative to each other from corresponding positions in a purely parabolic cross-section, so that said transverse cross-section is at least approximately in the form of a flattened parabola.

* * * * *